US010252143B1

(12) United States Patent
Schott

(10) Patent No.: US 10,252,143 B1
(45) Date of Patent: Apr. 9, 2019

(54) TIMING SYSTEM

(71) Applicant: WAVE Technologies, Inc., Gardner, KS (US)

(72) Inventor: James E. Schott, Hesston, KS (US)

(73) Assignee: WAVE Technologies, Inc., Hesston, KS (US)

( * ) Notice: Subject to any disclaimer, the term of this patent is extended or adjusted under 35 U.S.C. 154(b) by 0 days.

(21) Appl. No.: 15/922,953

(22) Filed: Mar. 16, 2018

Related U.S. Application Data

(60) Provisional application No. 62/547,751, filed on Aug. 18, 2017.

(51) Int. Cl.
*A63B 5/10* (2006.01)
*A63B 71/06* (2006.01)
*G04F 10/00* (2006.01)

(52) U.S. Cl.
CPC ..... *A63B 71/0686* (2013.01); *G04F 10/00* (2013.01); *A63B 5/10* (2013.01); *A63B 2207/02* (2013.01); *A63B 2208/03* (2013.01); *A63B 2220/62* (2013.01); *A63B 2220/801* (2013.01); *A63B 2225/50* (2013.01); *A63B 2244/20* (2013.01)

(58) Field of Classification Search
CPC ..... A63B 71/0686; G04F 10/00
USPC ..... 340/323 R
See application file for complete search history.

(56) References Cited

U.S. PATENT DOCUMENTS 3,944,763 A * 3/1976 Beierwaltes ..... A63B 31/00 200/52 R
5,702,799 A * 12/1997 Brown ..... B32B 5/16 428/143
7,358,456 B1 * 4/2008 Julian ..... A63B 69/12 200/512
7,403,135 B1 * 7/2008 Kaski ..... A63B 71/0605 200/600
2010/0304934 A1 * 12/2010 Woodson ..... A63B 24/0062 482/8
2013/0014585 A1 * 1/2013 Hetherington ..... G07C 1/22 73/514.16

* cited by examiner

*Primary Examiner* — Kerri L McNally

(57) ABSTRACT

An aquatic timing system includes a plurality of timing apparatuses, each timing apparatus including a primary portion with a front touch area and a display for presenting visual information, the display forming part of the front touch area. Each timing apparatus further includes a flange portion extending from an edge of the primary portion and a sensor for detecting a touch event occurring on the front touch area of the primary portion. An enclosure is mounted on the flange portion and contains a controller in communication with the sensor. The controller is configured to receive a signal from the sensor and identify a touch event from the signal, communicate a wireless signal to an external device including event time information associated with the timing apparatus, and receive a wireless signal containing event information and cause the display to present the event information.

19 Claims, 15 Drawing Sheets

TIMING SYSTEM

RELATED APPLICATIONS

The present application claims priority under 35 U.S.C. § 119 to U.S. Provisional Application Ser. No. 62/547,751, filed Aug. 18, 2017. The full disclosure, in its entirety, of U.S. Provisional Application Ser. No. 62/547,751 is hereby incorporated by reference.

FIELD

Embodiments of the present invention relate to timing apparatuses for use in sporting events. More particularly, embodiments of the present invention relate to timing apparatuses for use with aquatic timing systems used in aquatic sporting events.

BACKGROUND

In sporting competitions it is often necessary to determine an exact time when an event occurred, such as when a participant completed a race. In swimming competitions a race typically begins upon the sounding of a start horn and ends for each swimmer when that swimmer reaches an end of a swim lane after completing one or more laps. Existing solutions for determining a swimmer's race time include a timing mechanism that measures an elapsed time between the sounding of the start horn and the moment the swimmer reaches the end of the swim lane at the completion of the race. Such systems use touchpads mounted on a wall of the swimming pool at the end of the swim lane to determine a time when the swimmer has reached the end of the lane by detecting when the swimmer touched the touchpad.

The above section provides background information related to the present disclosure which is not necessarily prior art.

SUMMARY

An aquatic timing system according to an embodiment of the invention comprises a plurality of timing apparatuses and a central control system in wireless communication with each of the timing apparatuses. Each timing apparatus includes a rigid and planar primary portion with a length of between four feet and eight feet and a width of between one foot and four feet, the primary portion including a front touch area and a display for presenting visual information, the display forming part of the front touch area. A flange portion extends from an edge of the primary portion such that the primary portion and the flange portion form an angle of between forty-five degrees and one hundred thirty-five degrees, the flange portion being smaller than the primary portion.

Each timing apparatus further includes one or more sensors for detecting a touch event occurring on the front touch area of the primary portion, including a touch event occurring on or over the display, and generating one or more signals in response to detecting the touch event. An enclosure is mounted on the flange portion and contains a timing apparatus controller in communication with the sensor. The timing apparatus controller is configured to receive the one or more signals from the one or more sensors and identify a touch event from the one or more signals, communicate a wireless signal including event time information associated with the timing apparatus, and receive a wireless signal containing event information and cause the display to present the event information.

A central control system is in wireless communication with each of the timing apparatuses and is configured to receive the wireless signal from each timing apparatus and determine an outcome of an event.

An aquatic timing system according to another embodiment of the invention comprises a plurality of timing apparatuses and a central control system in wireless communication with each of the timing apparatuses. Each timing apparatus includes a rigid and planar primary portion with a length of between four feet and eight feet and a width of between one foot and four feet, the primary portion including a front touch area and an active visual indicator for presenting visual information, the active visual indicator being associated with the front touch area. A flange portion extends from an edge of the primary portion such that the primary portion and the flange portion form an angle of between forty-five degrees and one hundred thirty-five degrees, the flange portion being smaller than the primary portion.

Each timing apparatus further includes one or more sensors for detecting a touch event occurring on the front touch area of the primary portion, including a touch event occurring on or over the visual indicator, and generating one or more signals in response to detecting the touch event. An enclosure is mounted on the flange portion and contains a timing apparatus controller in communication with the sensor. The timing apparatus controller is configured to receive the one or more signals from the one or more sensors and identify a touch event from the one or more signals, communicate a wireless signal including event time information associated with the timing apparatus, and receive a wireless signal containing event time information and cause the visual indicator to reflect the event information.

A central control system is in wireless communication with each of the timing apparatuses and is configured to receive the wireless signal from each timing apparatus and determine an outcome of an event.

These and other important aspects of the present invention are described more fully in the detailed description below. The invention is not limited to the particular methods and systems described herein. Other embodiments may be used and/or changes to the described embodiments may be made without departing from the scope of the claims that follow the detailed description.

DRAWINGS

Embodiments of the present invention are described in detail below with reference to the attached drawing figures, wherein:

FIG. 1 is a perspective environmental view of a timing apparatus constructed in accordance with embodiments of the invention.

FIG. 2 includes a front elevation view, a side elevation view and a plan view of the timing apparatus of FIG. 1.

Figure 11:
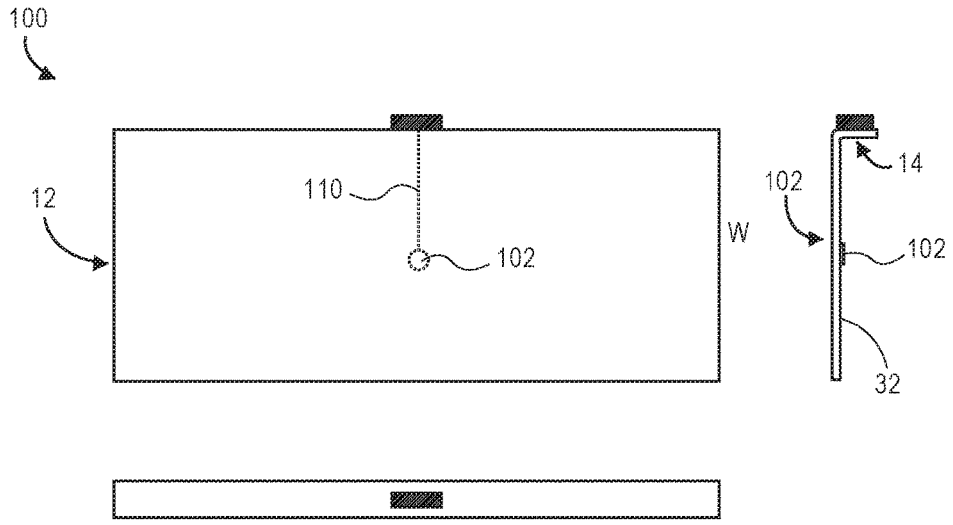

FIG. 11 includes a front elevation view, a side elevation view and a plan view of a timing apparatus constructed in accordance with another embodiment of the invention.

Figure 12:
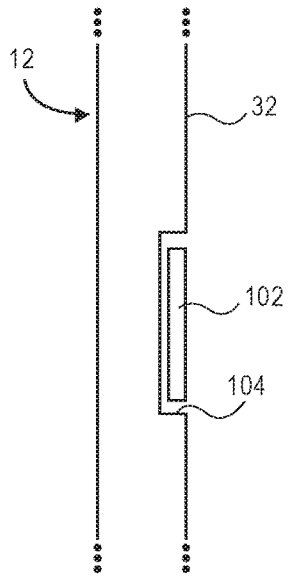

FIG. 12 is a side elevation view of a portion of an alternative construction of the timing apparatus of FIG. 11.

Figure 13:
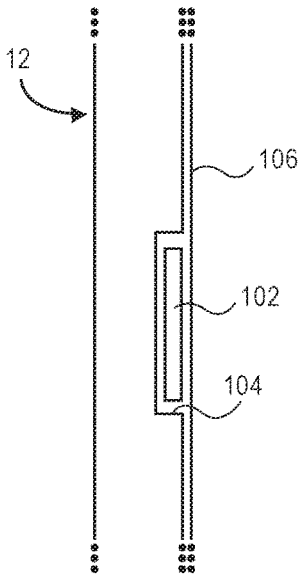

FIG. 13 is a side elevation view of a portion of an alternative construction of the timing apparatus of FIG. 11.

Figure 14:
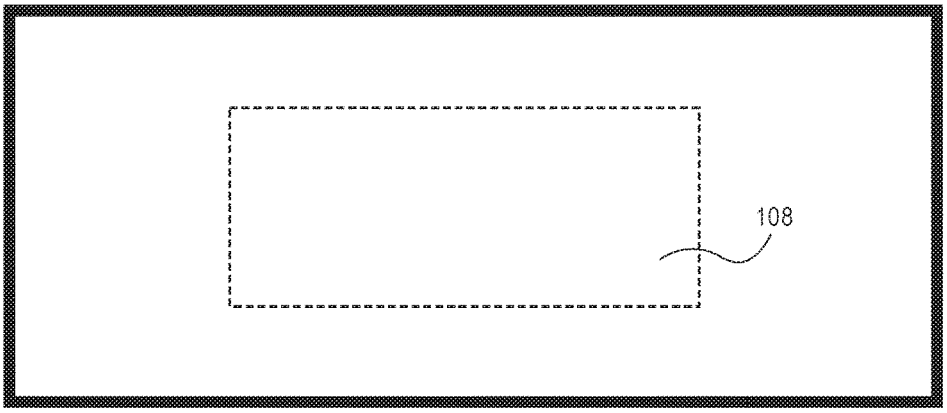

FIG. 14 is a front elevation view of the timing apparatus of FIG. 11 illustrating a central region of a front-facing surface of the timing apparatus.

Figure 15:
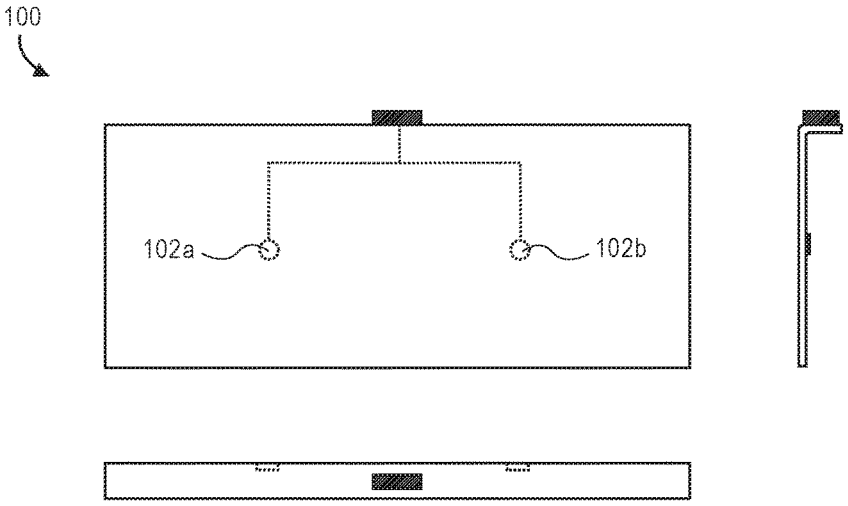

FIG. 15 includes a front elevation view, a side elevation view and a plan view of a timing apparatus constructed in accordance with another embodiment of the invention.

Figure 16:
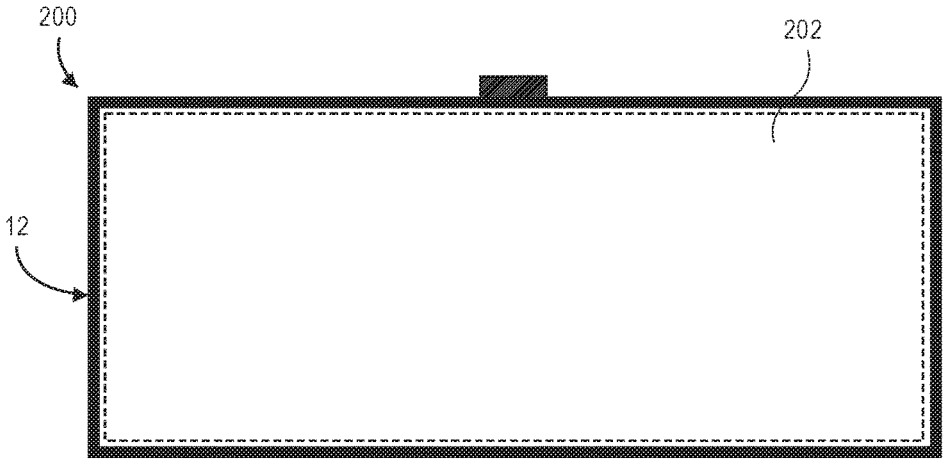

FIG. 16 is a front elevation view of a timing apparatus constructed in accordance with another embodiment of the invention.

Figure 17:
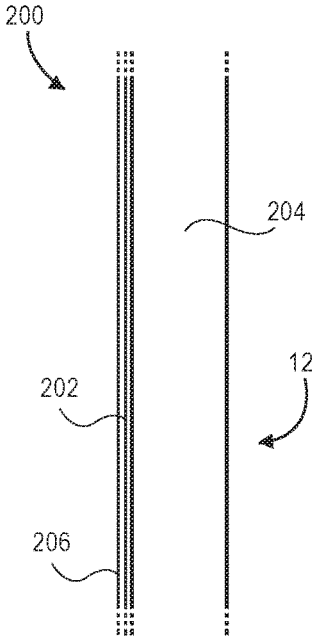

FIG. 17 is a side elevation view of a portion of the timing apparatus of FIG. 16.

Figure 18:
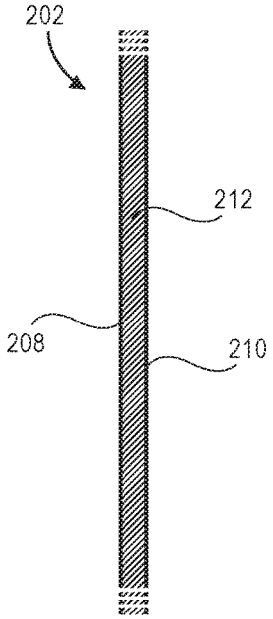

FIG. 18 is a side elevation view of a portion of a force sensitive resistor that forms part of the timing apparatus of FIG. 16.

Figure 19:
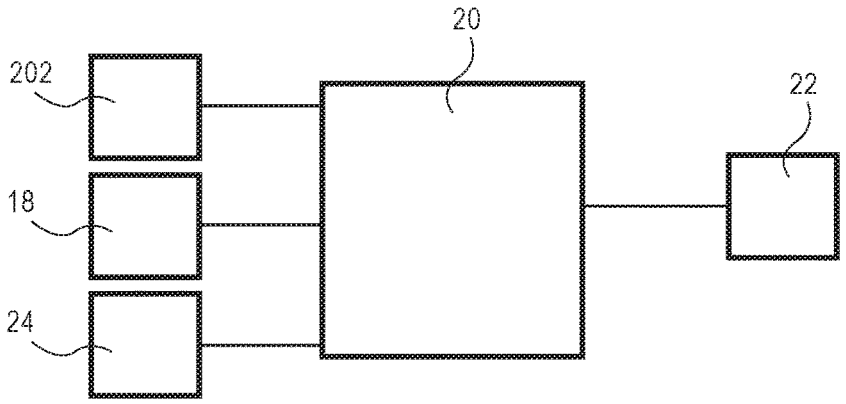

FIG. 19 is a block diagram of various components of a timing system associated with the timing apparatus of FIG. 16.

Figure 20:
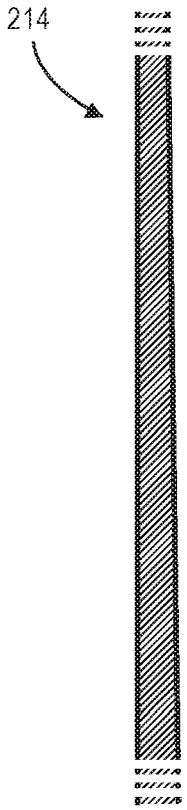

FIG. 20 is a side elevation view of a portion of an alternative force sensitive resistor that forms part of the timing apparatus of FIG. 16.

Figure 21:
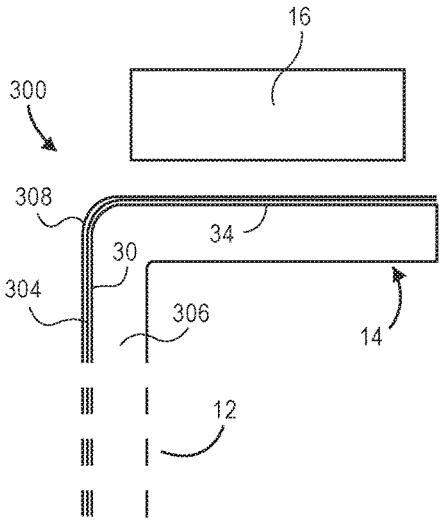

FIG. 21 is an exploded side elevation view of a portion of a timing apparatus constructed in accordance with another embodiment of the invention and including a capacitance sensor.

Figure 22:
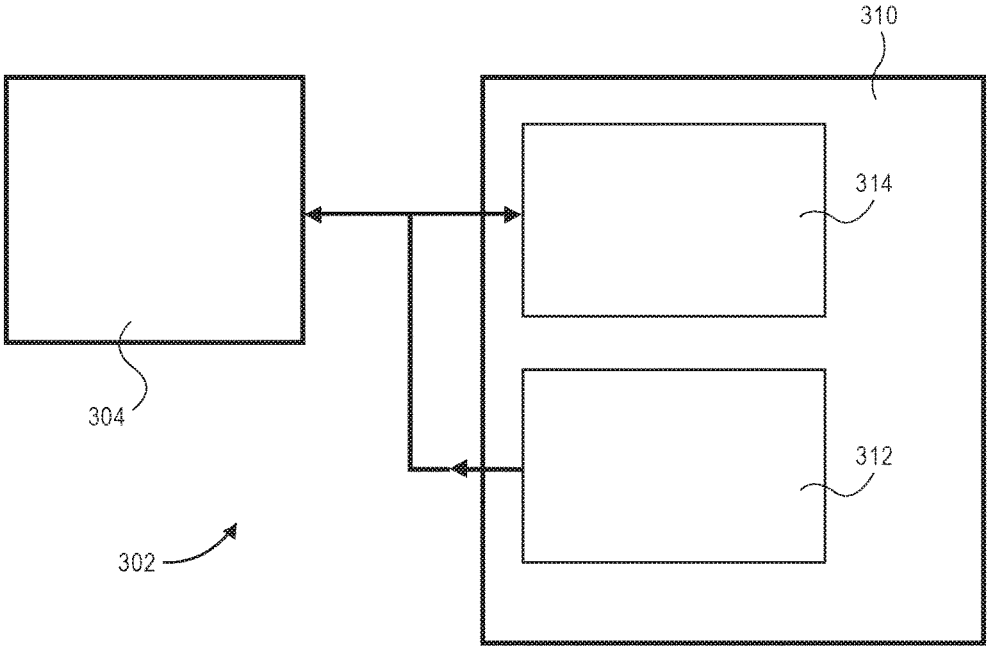

FIG. 22 is a block diagram of various control components used with the capacitance sensor of the timing apparatus of FIG. 21.

Figure 23:
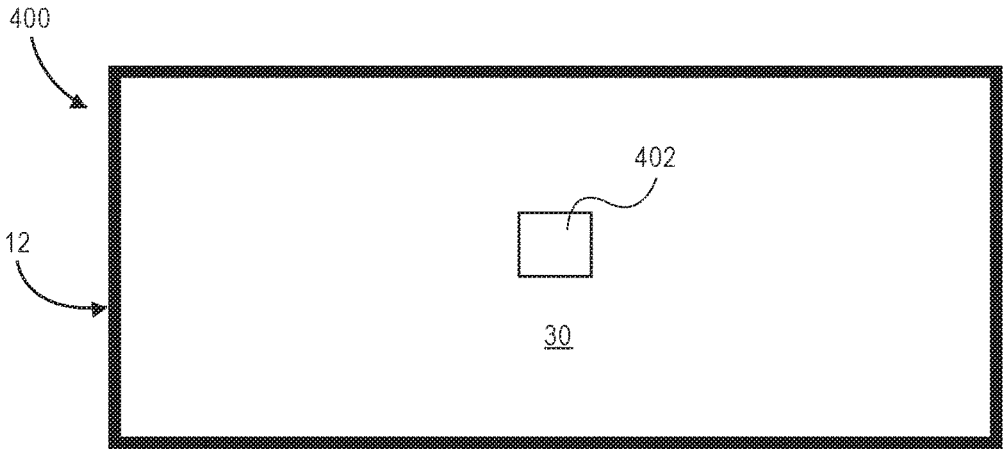

FIG. 23 is a front elevation view of a timing apparatus constructed in accordance with another embodiment of the invention and including a display.

Figure 24:
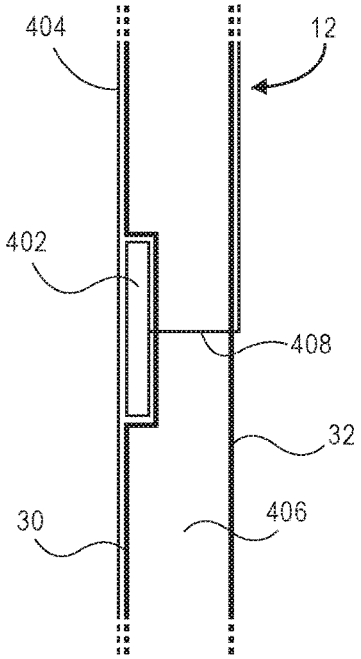

FIG. 24 is a side elevation view of a portion of the timing apparatus of FIG. 23.

Figure 25:
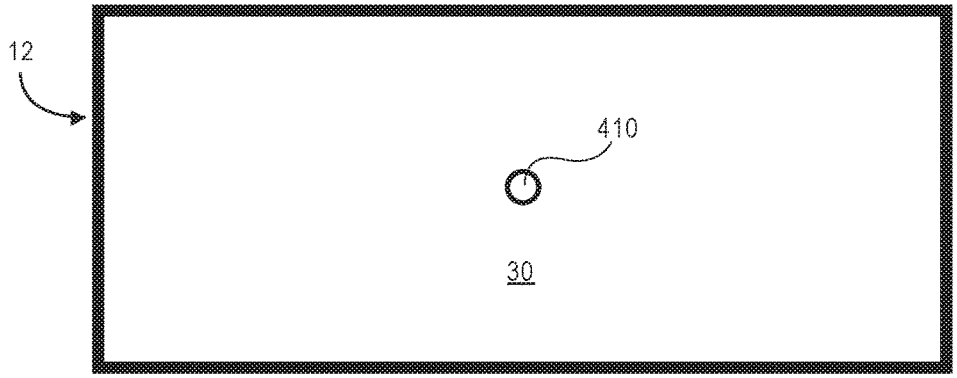

FIG. 25 is a front elevation view of a timing apparatus constructed in accordance with another embodiment of the invention and including a single light source.

Figure 26:
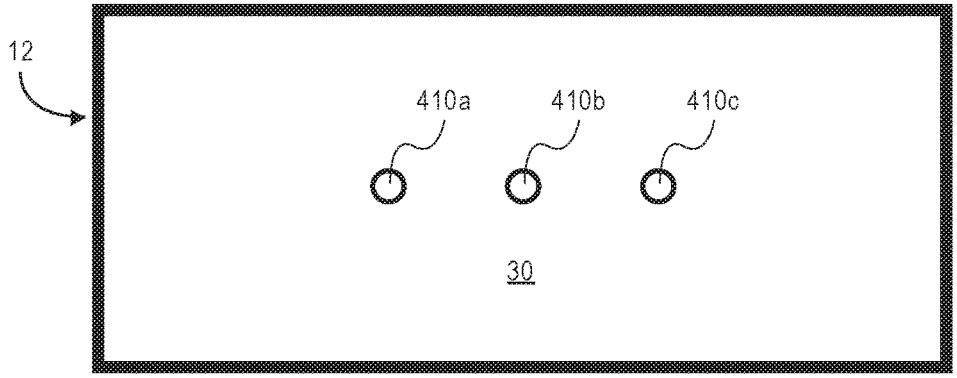

FIG. 26 is a front elevation view of a timing apparatus constructed in accordance with another embodiment of the invention and including a plurality of light sources.

Figure 27:
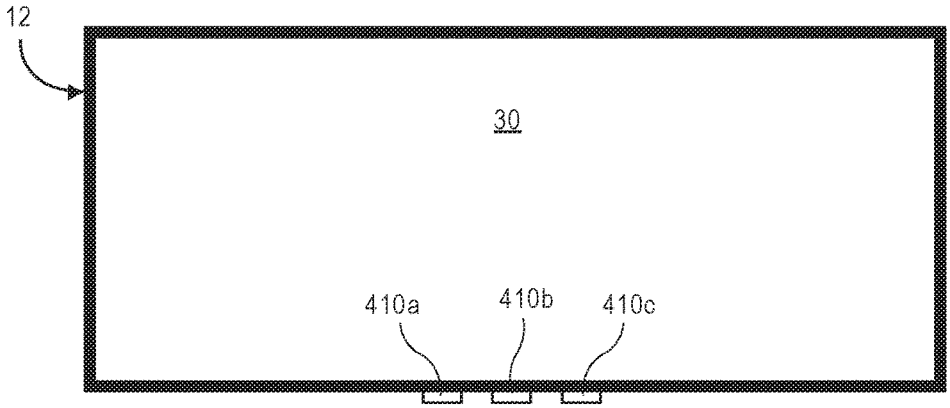

FIG. 27 is a front elevation view of a timing apparatus constructed in accordance with another embodiment of the invention and including a plurality of light sources.

Figure 28:
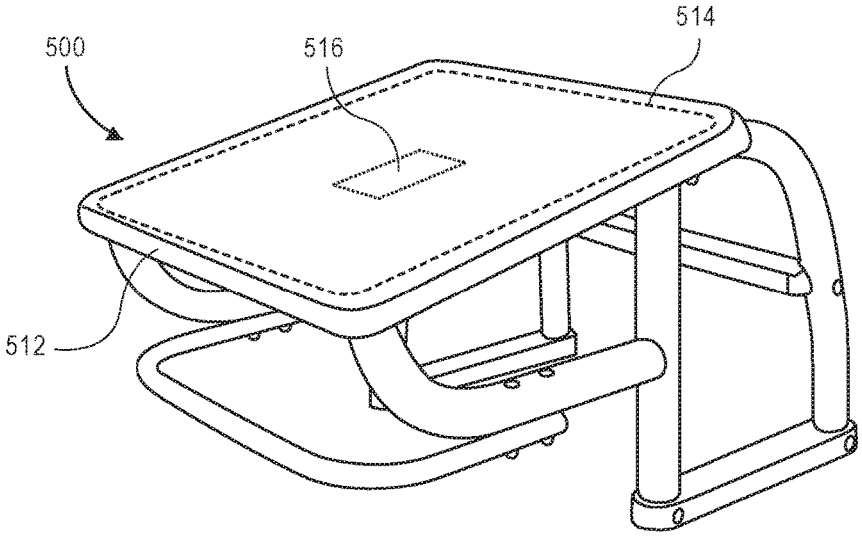

FIG. 28 is a starting block constructed in accordance with another embodiment of the invention and including a timing system.

Figure 29:
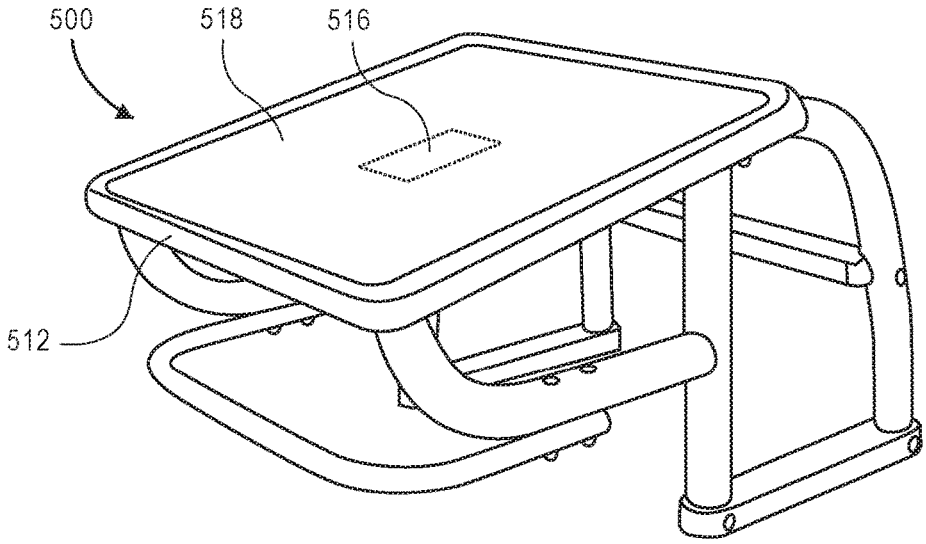

FIG. 29 is a starting block constructed in accordance with another embodiment of the invention and including a pad with a timing system.

Figure 30:
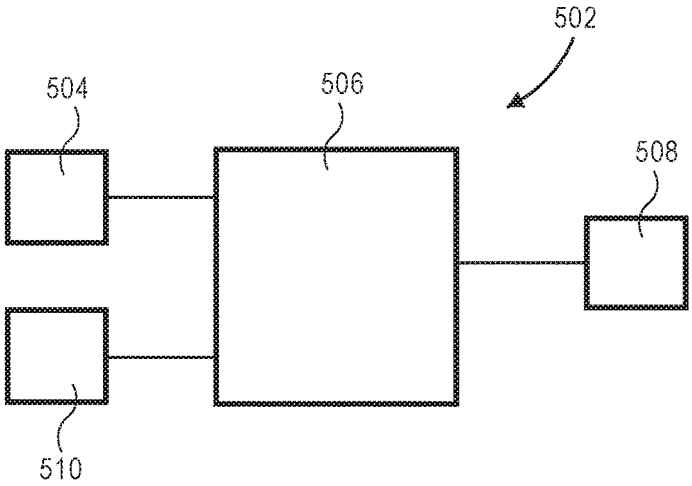

FIG. 30 is a block diagram of various components of a timing system that may be used with either of the starting blocks of FIG. 28 and FIG. 29.

Figure 31:
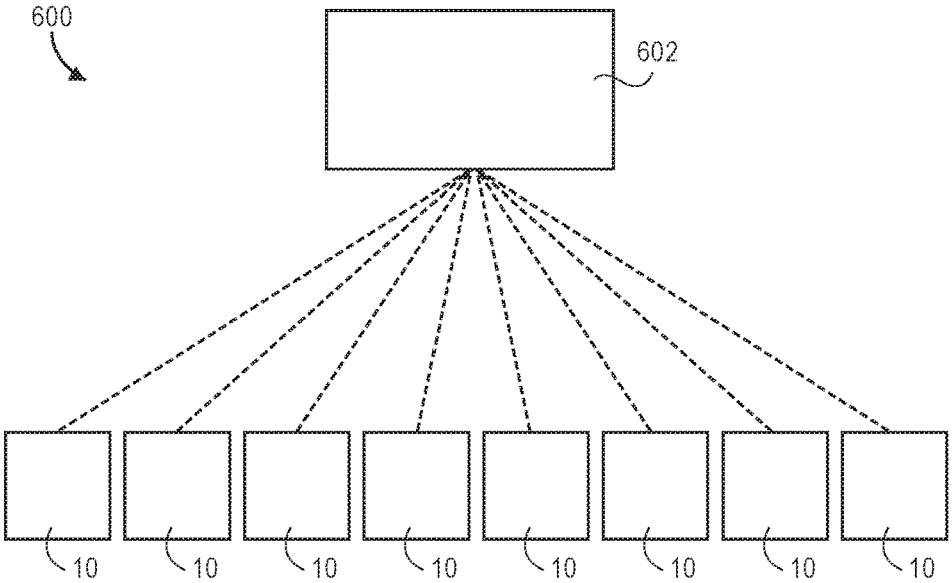

FIG. 31 is an aquatic timing system constructed in accordance with embodiments of the invention.

Figure 32:
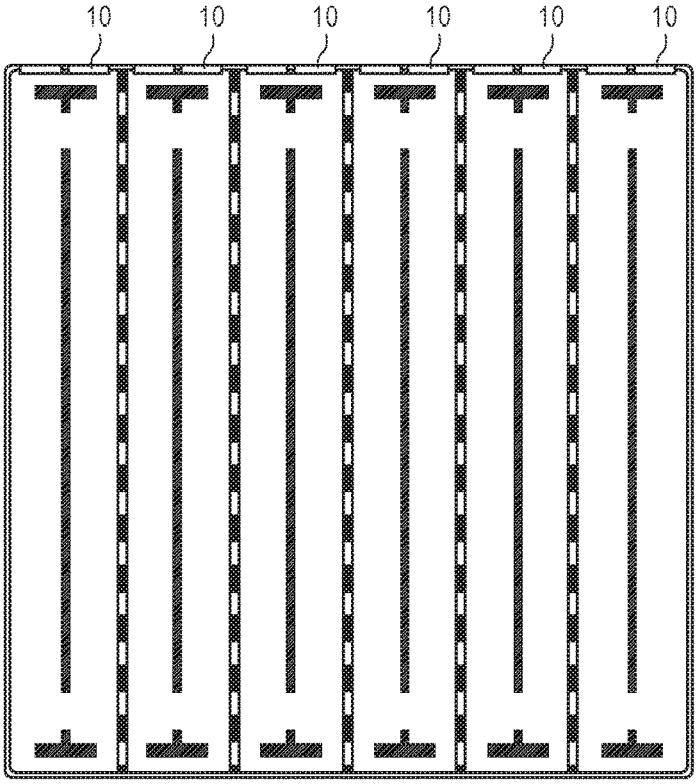

FIG. 32 is a plan view of a pool including an aquatic timing system.

Figure 33:
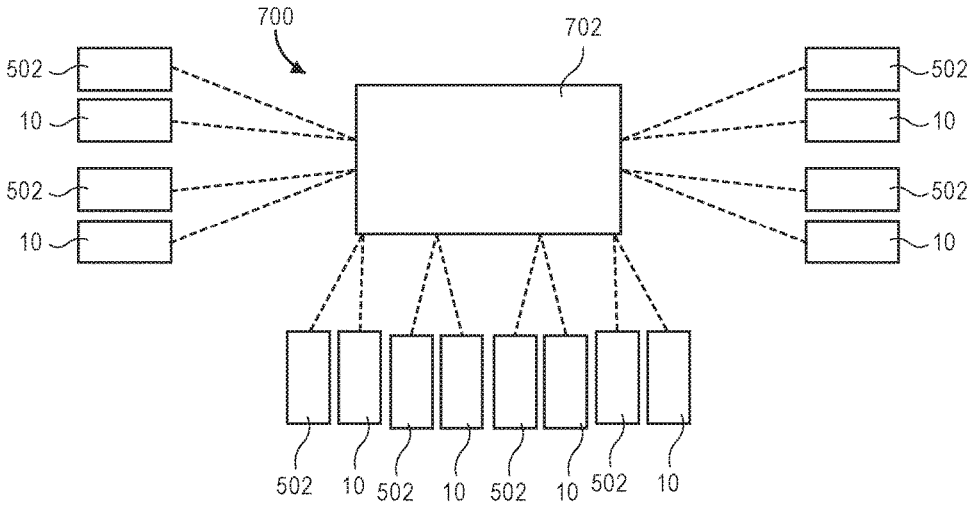

FIG. 33 is an aquatic timing system constructed in accordance with another embodiment of the invention.

Figure 34:
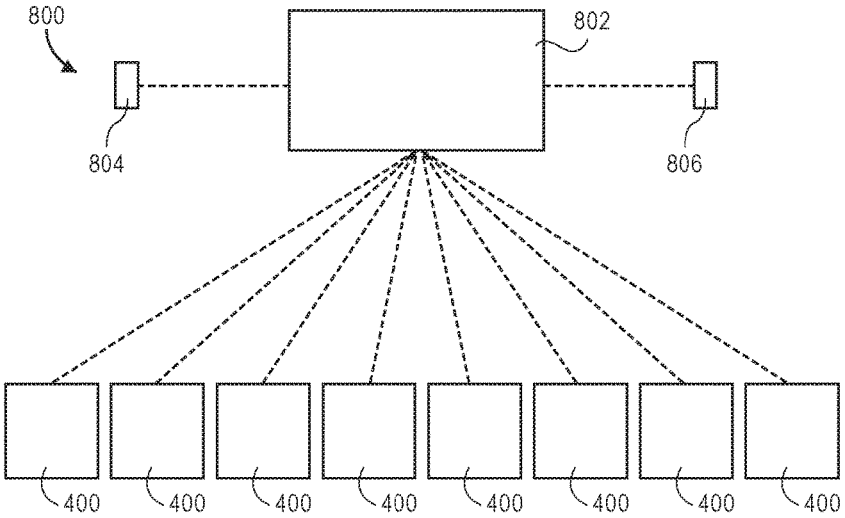

FIG. 34 is an aquatic timing system constructed in accordance with another embodiment of the invention.

The drawing figures do not limit the present invention to the specific embodiments disclosed and described herein. The drawings are not necessarily to scale, emphasis instead being placed upon clearly illustrating the principles of the invention.

DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the spirit and scope of the invention as defined by the claims. The following description is, therefore, not to be taken in a limiting sense. Further, it will be appreciated that the claims are not necessarily limited to the particular embodiments set out in this description.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etcetera described in one embodiment may also be included in other embodiments, but is not necessarily included. Thus, the present technology can include a variety of combinations and/or integrations of the embodiments described herein. The same reference numeral used with two or more embodiments indicates the same element or component.

When elements or components are referred to herein as being "connected" or "coupled," the elements or components may be directly connected or coupled together or one or more intervening elements or components may also be present. In contrast, when elements or components are referred to as being "directly connected" or "directly coupled," there are no intervening elements or components present.

Figure 1:
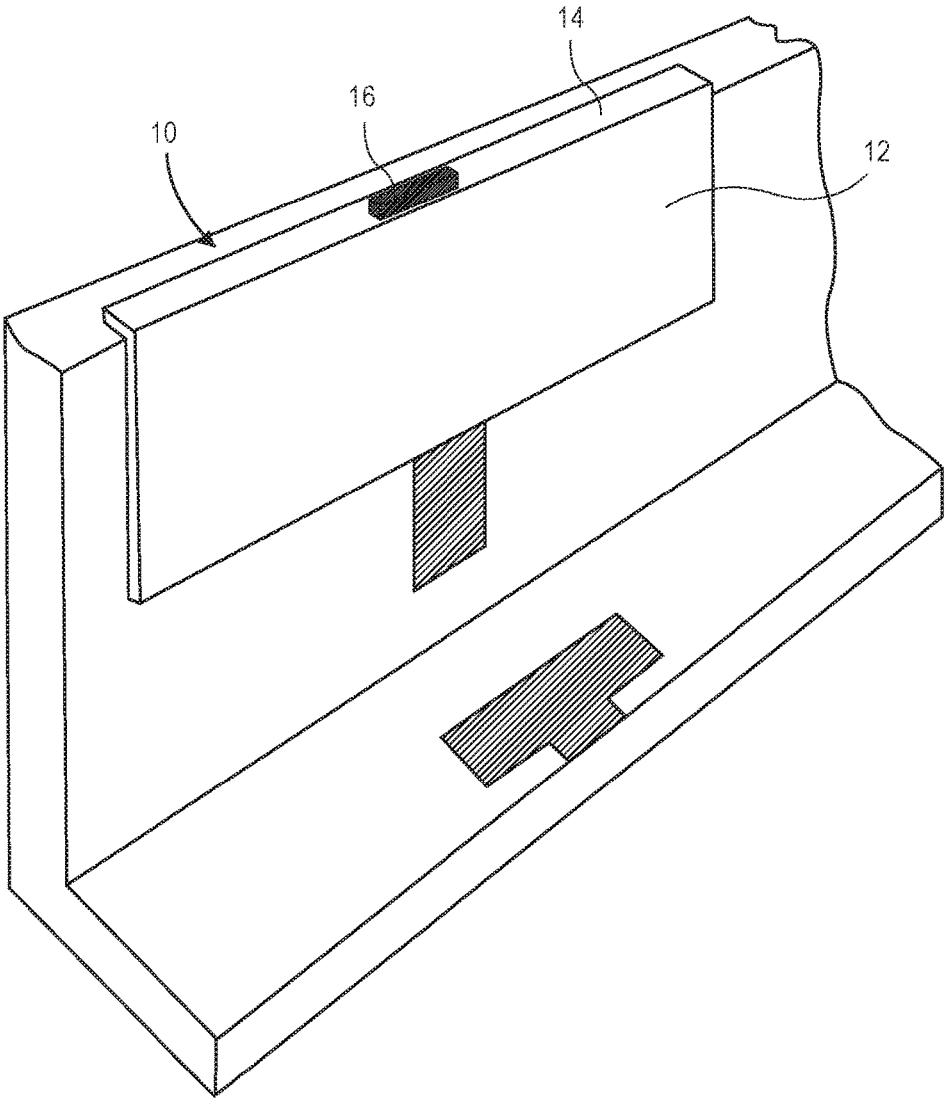
Figure 2:
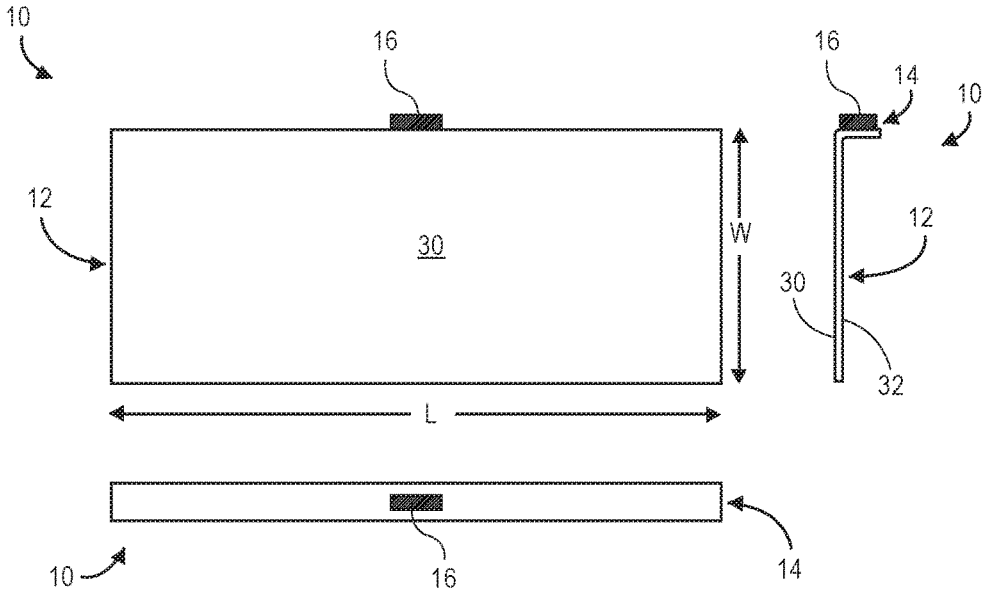

Turning now to the drawing figures, and initially FIGS. 1-6, a timing apparatus 10 constructed in accordance with embodiments of the invention is illustrated. The timing apparatus 10 is configured for use with an aquatic timing system and generally includes a primary portion 12, a flange portion 14 extending at an angle from the primary portion 12 and an enclosure 16 mounted on the flange portion 14. FIG. 2 includes three views of the timing apparatus 10 including a front elevation view (top left), a side elevation view (top right) and a plan view (bottom). The enclosure 16 houses at least a sensor 18, a controller 20, a wireless communications module 22, and an energy source 24 such as a battery.

The timing apparatus 10 is configured to be mounted on a wall of a swimming pool, as illustrated in FIG. 1, so that when a swimmer engages the timing apparatus 10, such as by touching the primary portion 12 or the flange portion 14 at the end of a race, the swimmer's touch causes a vibration of the timing apparatus 10 that is detected by the sensor 18 and is identified by the controller 20 as a touch event. The controller 20 may use that information to, for example, automatically determine or assist in determining a competitor's swim time in a swimming race and wirelessly communicate competition information to an external device, as explained below in greater detail.

The primary portion 12 presents a generally rectangular and planar shape and is rigid or substantially rigid. As used herein, "rigid" includes unyielding to pressure under ordinary use or yielding somewhat to pressure (for example, less than ten percent deformation) under ordinary use but returning to its original shape and form. It may be desirable or necessary for the primary portion 12 to be rigid so that, for example, swimmers can effectively engage and push off of the primary portion 12 during a swimming event and so that competition times are accurately and uniformly recorded across multiple timing apparatuses.

In the embodiment illustrated in FIGS. 1-6, both the primary portion 12 and the flange portion 14 are constructed from a single, monolithic element that is bent to form an angled section 26 where the primary portion 12 and the flange portion 14 intersect. Alternatively, the primary portion 12 and the flange portion 14 may be separate pieces of material that are joined together at the angled section 26. Additionally, in other embodiments the monolithic element may span only a portion of the flange portion 14 and/or only a portion of the primary portion 12.

Figure 7:
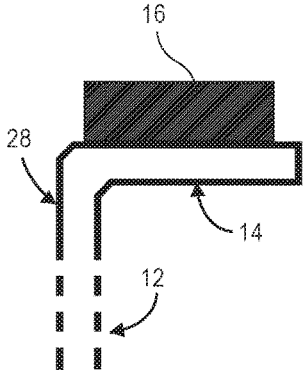
FIG. 7 is a side elevation view of a portion of a timing apparatus constructed in accordance with another embodiment of the invention.
Figure 8:
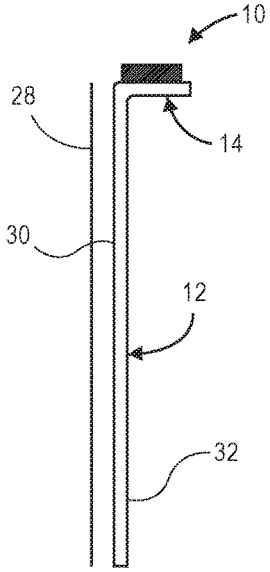
FIG. 8 is an exploded side elevation view of the timing apparatus of FIG. 7.

In some embodiments, the primary portion 12, the flange portion 14 or both may include one or more layers of material in addition to the monolithic element. An exemplary layer of material 28 covering a front-facing surface 30 of the primary portion 12 is illustrated in FIGS. 7 and 8, wherein FIG. 8 is an exploded view illustrating the layer of material 28 separated from the primary portion 12. In this embodiment of the invention the monolithic element is still present but serves as a substrate beneath the outer layer of material 28. The layer of material 28 may serve to provide a more effective grip for competitors who use the timing apparatus 10, to dampen vibrations on the timing apparatus 10 for more effective detection of a touch event, to provide a surface for printing graphics or other visual indicators, or a combination of these purposes. Thus, the layer of material 28 may be malleable and softer than the more rigid monolithic element. In some embodiments of the invention the layer of material 28 is made of or includes vinyl and is thinner and softer than the monolithic element. In other embodiments of the invention the layer of material 28 is made of or includes neoprene or other synthetic rubber. It will be appreciated, however, that the invention is not so limited and that other materials of varying thicknesses and hardness may be used without departing from the spirit or scope of the invention.

The embodiment illustrated in FIGS. 7 and 8 includes a single layer of material 28 on a single, front-facing surface 30 of the primary portion 12, but it will be appreciated that the invention is not so limited and that other configurations are within the ambit of the invention. By way of example, a second layer of material may be placed on a second, rear-facing surface 32 of the primary portion 12. Similarly, one or more layers of material may cover the front-facing surface 30 of the primary portion 12 as well as a top-facing surface 34 of the flange portion 14. In some embodiments of the invention a layer of material covers or encases the entire monolithic element including all faces and edges, and in other embodiments of the invention multiple layers of material are used on top of one or more surfaces of the monolithic element.

Figure 9:
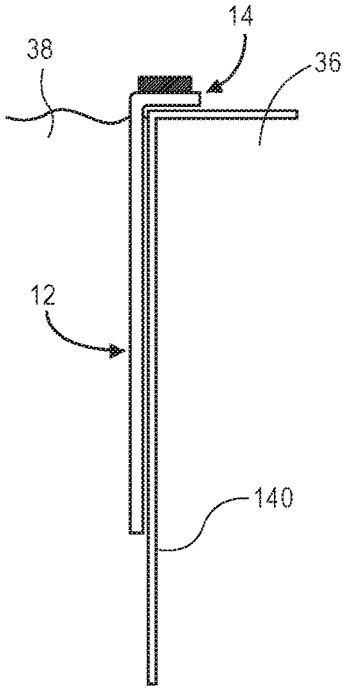
FIG. 9 is a side elevation environmental view of the timing apparatus of FIG. 1, illustrating the timing apparatus in a swimming pool.

With particular reference to FIGS. 1 and 9, the flange portion 14 extends at an angle and from an edge of the primary portion 12 and is configured to support the weight of the timing apparatus 10 such that the flange portion 14 can be placed to engage the edge of a swimming pool 36 and hold the timing apparatus 10 in the water 38 such that the primary portion 12 depends from the flange portion 14 and extends downward into the swimming pool 36 parallel with and adjacent to (or proximate) a wall 40 of the swimming pool 36. The flange portion 14 may extend from the primary portion 12 at an angle Θ (FIG. 4) of between forty-five degrees and one-hundred thirty-five degrees, or at an angle Θ of between sixty degrees and one-hundred twenty degrees. More particularly, the flange portion 14 may extend from the primary portion 12 at an angle Θ of seventy degrees, eighty degrees, ninety degrees, one hundred degrees or one hundred ten degrees. In the illustrated embodiment, the flange portion 14 extends at an angle Θ of ninety degrees from the primary portion 12, is smaller than the primary portion 12, presents a planar, rectangular shape and is of a rigid construction.

In some embodiments, the primary portion 12 presents a length L of between four feet and eight feet, a width W of between one foot and four feet, and a thickness of between one-eighth of an inch and one-half of an inch. In another embodiment, the primary portion 12 presents a length of between five feet and seven feet, a width of between two feet and three feet, and a thickness of about one-quarter of an inch.

In some embodiments, the flange portion 14 presents a length L of between four feet and eight feet, a width of between one inch and ten inches, and a thickness of between one-eighth inch and one-half inch. In other embodiments, the flange portion 14 presents a length L of between five feet and seven feet, a width of between two inches and eight inches, and a thickness of about one-quarter of an inch. The flange portion 14 may be solid and extend the entire length of the primary portion 12, as illustrated, or may be attached to the primary portion at discreet locations and/or be a different length than the primary portion 12.

The enclosure 16 is a waterproof housing mounted on the timing apparatus 10 such that it forms a watertight internal chamber for containing and protecting the controller 20, wireless communications module 22, sensor 18 and the energy source 24. The enclosure 16 may be constructed of a rigid material such as polyvinyl chloride ("PVC") or other synthetic plastic polymer and include a hole (not illustrated) in a bottom wall (adjacent the top-facing surface 34 of the flange portion 14) so that the sensor 18 may be placed in the hole and adjacent the top-facing surface 34 of the flange portion 14. The bottom wall of the enclosure 16 may then be sealed to the top-facing surface 34 of the flange portion 14 using, for example, an epoxy to both adhere the enclosure 16 to the flange portion 14 and to create a water-tight seal preventing water from entering the enclosure 16 through the hole in the bottom wall. Alternatively, the bottom wall of the enclosure 16 may not include a hole, but the sensor 18 may be placed and configured to detect a vibration through the walls of the enclosure 16. The energy source 24 and the controller 20 are also contained within the enclosure 16 such that the controller 20 may be connected to the sensor 18 and the energy source 24 may energize the sensor 18, the controller 20, or both. The enclosure 16 may comprise two parts (not illustrated) secured together using screws or other removable attachment devices to allow access to the components housed inside the enclosure 16.

In another embodiment, the enclosure 16 comprises five walls in a box shape with an open bottom such that, when the enclosure 16 is mounted on and adhered to the flange portion 14 of the timing apparatus 10, the flange portion 14 forms a sixth wall defining the internal chamber. In this embodiment, as in the previous embodiment, the sensor 18 may be mounted directly on the flange portion 14 of the timing apparatus 10 while housed within the internal chamber.

The timing apparatus 10 is constructed such that the sensor 18 detects a touch event occurring anywhere on the timing apparatus 10, including a touch event occurring on the angled section 26 and on the edges of the timing apparatus 10. This is possible because a touch event occurring on the angled section 26 or on an edge causes a vibration of the timing apparatus 10 that propagates through the primary portion 12, the flange portion 14, or both and reaches the sensor 18. Thus, the system is configured to detect touch events occurring on edges of the primary portion 12, on edges of the flange portion 14 and on the angled section 26. This is advantageous in that there are no "dead spots" on the timing apparatus where a touch is not detected by sensors or identified by the controller 20.

In operation at least part of the primary portion 12 is submerged in water, as illustrated in FIG. 9, therefore it should be constructed of a material that is capable of operating when submerged in water and that will not deteriorate from contact with water or from repeated drying cycles. If the primary portion 12 and the flange portion 14 are constructed only of a single, monolithic element that element may be PVC, stainless steel or other material suitable for use in water. Furthermore, it can be helpful (or even necessary in some applications) for the primary portion 12 to be constructed of a material that is not buoyant so that the timing apparatus 10 remains firmly in place when resting on an edge of a swimming pool and the primary portion 12 is mostly or completely submerged in water.

Figure 6:
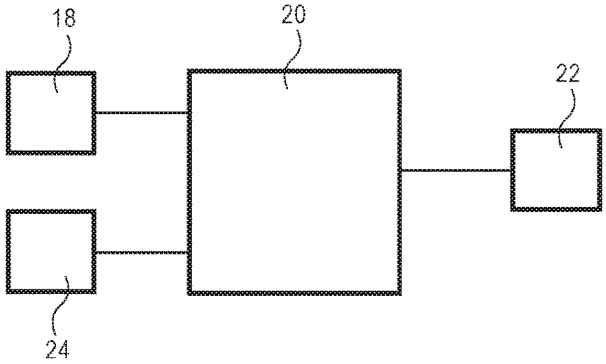
FIG. 6 is a block diagram of various components of a timing system associated with the timing apparatus of FIG. 1.

A system diagram is illustrated in FIG. 6 and includes the energy source 24, the controller 20, the vibration sensor 18 and the wireless communications module 22. While each of these components is depicted separately in the diagram, it will be appreciated that two or more may be combined into a single physical device. For example, it is common for a single integrated circuit to include the controller 20 and the wireless communications module 22. All of the components 18, 20, 22 and 24 may be included in a single physical device, such as a single integrated circuit.

The controller 20 may comprise or include one or more microprocessors, microcontrollers, programmable logic devices, discrete analog or digital electronic components, or a combination thereof. In some embodiments of the invention, the controller 20 is a microprocessor programmed or configured to receive a wireless start signal from an external source via the wireless communications module 22, start a timing clock upon receipt of the wireless start signal, receive a signal from the sensor 18, analyze the signal to determine if it was caused by a touch event, stop the timing clock if it determines that the signal corresponds to a touch event, and communicate a wireless signal indicating an elapsed time via the wireless communications module 22.

In other embodiments, the controller 20 does not receive a start signal and does not determine an elapsed time between a start signal and a touch event, but rather wirelessly communicates an indication of when the touch event occurred. The controller 20 may communicate an indication of when the touch event occurred by generating a timestamp corresponding to the time of the touch event and communicating the timestamp, or simply including in the signal an indication that the touch event occurred such that an external device correlates the time of the touch even with the receipt of the wireless signal. Similarly, the controller 20 may be configured to determine times associated with multiple legs of a race, such as a swim race that includes multiple laps or a relay race that involves multiple swimmers. In those situations the controller 20 may be configured to determine an elapsed time for each lap, for each swimmer or both. The controller 20 may be in communication with an external electronic device and may receive competition information (for example, number of laps in a race, number of swimmers in a relay, number of laps associated with each swimmer, etcetera) from the external device may communicate competition results to the external device.

The vibration sensor 18 may be a piezoelectric sensor connected directly to the flange portion 14 of the timing apparatus 10. A piezoelectric sensor may present a flat, circular shape, for example, with a diameter of between one-quarter of an inch and two inches and a thickness of one-sixteenth of an inch, one-eighth of an inch or one-fourth of an inch. In some embodiments of the invention the vibration sensor 18 is the only sensor on the timing apparatus 10 for responding to a touch event. Using a single vibration sensor 18 that is housed within the enclosure 16 simplifies construction and operation of the timing apparatus 10 by eliminating the need for wires or other conductive elements connecting one or more sensors outside the enclosure 16 with the controller 20 inside the enclosure 16. As explained below, in other embodiments of the invention the vibration sensor 18 is placed outside the enclosure 16, such as on the primary portion 12. In yet other embodiments of the invention one or more sensors may be placed outside the enclosure 16 in addition to the sensor 18 located inside the enclosure 16, wherein the controller 20 is in communication with both or all of the sensors. When multiple sensors are used the controller 20 may receive signals from all of the sensors and identify a touch event from all of the signals, as explained below in greater detail.

The controller 20 is programmed or configured to receive a signal from the vibration sensor 18 and to determine whether the signal corresponds to a touch event. As used herein, a "touch event" is a human touch on the timing apparatus used to determine an outcome or a characteristic of a competition. Splashing water may touch the timing apparatus 10 and cause a vibration that is picked up by the sensor 18, for example, but that event is not relevant to a characteristic or outcome of the race and the controller 20 may be configured to distinguish it from a human touch and ignore it. To identify a touch event, the controller 20 may analyze the signal from the sensor 18 to determine whether one or more characteristics of the signal exceeds a predetermined threshold.

Figure 10:
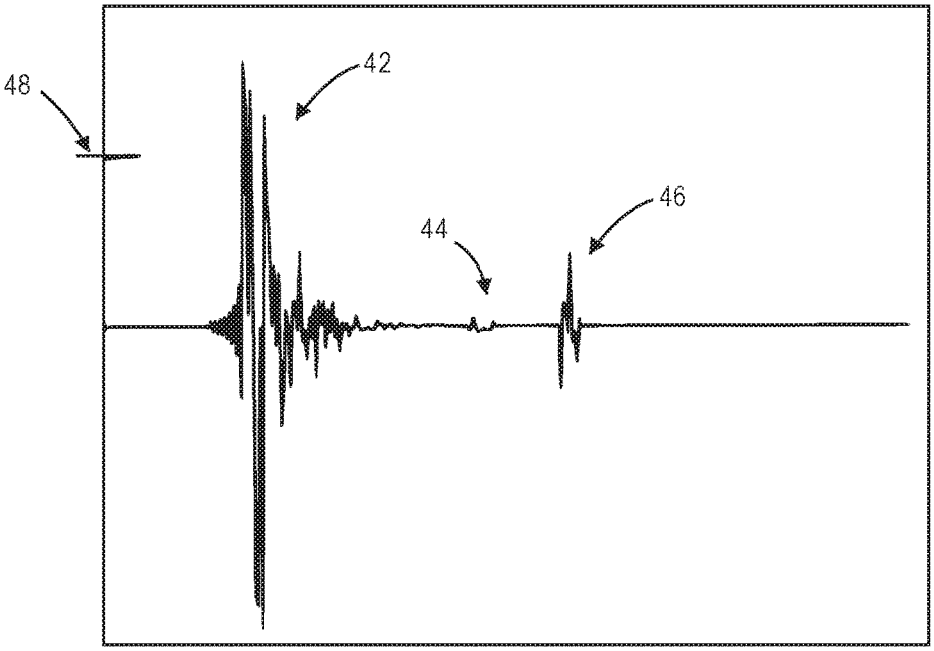
FIG. 10 illustrates an exemplary signal generated by a sensor associated with the timing apparatus of FIG. 1.

An exemplary signal is illustrated in FIG. 10 and corresponds to, for example, a voltage over time generated by the sensor 18. In the illustrated example there are three signal patterns 42, 44, 46 that likely resulted from a vibration of the timing apparatus 10. The controller 20 may analyze each of the patterns 42, 44, 46 to determine whether each corresponds to a touch event. If the controller 20 compares an amplitude of the signal to a predetermine threshold amplitude 48, for example, only the first pattern 42 would be identified as a touch event. The other two patterns 44, 46 may have resulted from, for example, water splashing against the primary portion 12, against the flange portion 14 or against the enclosure 16. The controller 20 may analyze other characteristics of the signal as well, such as a total amount of energy in the signal or a shape of the signal.

The controller 20 may be configured to allow a user to adjust the sensitivity of the timing apparatus 10 by adjusting, for example, a threshold used to determine whether a signal pattern corresponds to a touch event. A user may be using an external electronic device, for example, and select a desired sensitivity via a user interface of the external device. The external device may then communicate a wireless signal to the controller 20 via the wireless communications module 22, wherein the controller 20 adjusts the predetermined threshold used to determine whether a signal pattern corresponds to a touch event, such as the threshold 48. It may be desirable to adjust the sensitivity of the timing apparatus 10 for different events or different environments. If a first event competition includes adult swimmers the sensitivity may be decreased (that is, the threshold set higher) because adults engage the timing apparatus with greater force causing larger or more pronounced signal patterns. The same timing apparatus 10 may then be used with a second event competition including young children, wherein the sensitivity may be increased (that is, the threshold set lower) because the children engage the timing apparatus 10 with less force resulting in smaller or less pronounced signal patterns. Similarly, the configuration of a pool may result in more and/or larger waves hitting the timing apparatus 10 such that the sensitivity may need to be decreased to avoid the situation where the controller 20 identifies a wave hitting the timing apparatus 10 as a touch event.

The wireless communications module 22 may enable wireless communications between the controller 20 and an external device using any of various wireless communications protocols including, for example, IEEE 802.11 (Wi-Fi), Bluetooth, ZigBee and/or 433 MHz. The wireless communications module 22 may include a wireless transmitter, a wireless receiver, or both to enable one-way or two-way communications. The wireless communications module 22 and the controller 20 may be built into a single integrated circuit or the wireless communications module 22 may be a separate circuit that is in communication with the controller 20. The energy source 24 may be a rechargeable battery capable of energizing the controller 20 and/or other components. It will be appreciated that the system may include other components and modules not illustrated or discussed herein. The system may include, for example, a connector for allowing external connection to the energy source 24 for recharging, or an inductive charging antenna to enable inductive charging of the energy source 24.

Figure 3:
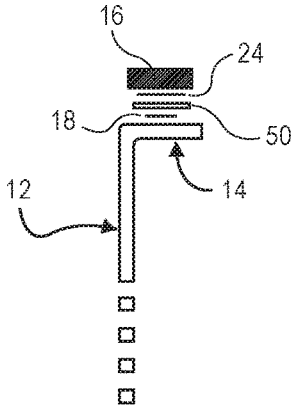
FIG. 3 is an exploded side elevation view of various components of the timing apparatus of FIG. 1.
Figure 4:
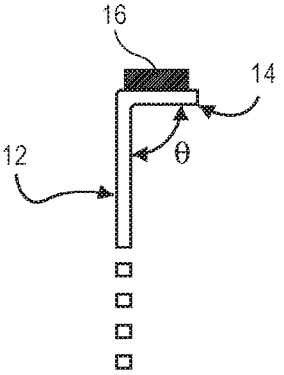
FIG. 4 is a side elevation view of a portion of the timing apparatus of FIG. 1.
Figure 5:
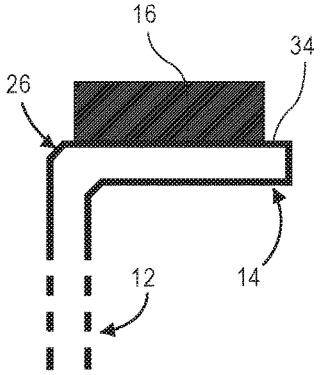
FIG. 5 is a side elevation view of a portion of the timing apparatus of FIG. 1.

FIG. 3 is an exploded view of a portion of the timing apparatus 10 illustrating how various components of the system may be housed within the enclosure 16. In some embodiments of the invention the sensor 18 is placed directly in contact with the flange portion 14 of the timing apparatus 10, such as where the sensor 18 is glued, welded or otherwise adhered to a top surface of the flange portion 14. The controller 20 and the wireless communications module 22 may be mounted on a printed circuit board 50. The energy source 24 may be mechanically connected to the printed circuit board 50, mechanically connected to an internal surface of the enclosure 16, or not connected to either. The energy source 24 is electrically connected to the controller 20, either directly or via the printed circuit board 50. The sensor 18 is communicatively coupled with the controller 20 via a direct connection or indirectly through the printed circuit board 50. It will be appreciated that the configuration illustrated in FIG. 2 is exemplary in nature and that the components of the system may be arranged differently. In some embodiments of the invention, for example, all of the components may be built into a single package, such as a single integrated circuit.

The configuration of the system depicted in FIG. 6 and the enclosure 16 described and illustrated herein presents various technical advantages. The use of a single vibration sensor 18 housed within the enclosure 16 reduces the complexity and cost of the system by eliminating the need for sensors placed elsewhere on the primary portion 12, the flange portion 14, or both, which would require wires or other conductive elements communicatively coupled with the controller 20 and extending, for example, along the primary portion 12, the flange portion 14 or both and passing through the enclosure 16 to connect to the controller 20 or to a circuit board 50 on which the controller 20 is mounted. Such a configuration would require ensuring that the wire is protected and/or operable while submerged in water and subject to the shock and use of competitive sporting events. The use of wireless communications and inductive charging may allow the enclosure 16 to be entirely sealed and waterproof, eliminating the need for waterproof ports passing through a wall of the enclosure 16 and subject to leaks. The strong waterproof nature of the enclosure 16 and its connection to the flange portion 14, for example, allows it to protect the electrical components contained therein from water splashing or washing over or against the enclosure 16 during normal use, as well as more extreme exposure such as incidents where the timing apparatus 10 sinks to the bottom of a pool.

If the primary 12 and flange 14 portions of the timing apparatus are constructed of a single monolithic element, the front-facing surface 30 of the primary portion 12 may be covered or textured to create a rough or non-slip surface. Giving the primary portion 12 of the timing apparatus 10 a rough outer surface is desirable as some swimming competitions require swimmers to push off of the timing apparatus 10, such as where the swimmer reverses direction at the end of the lane or starts a race while in the water. In those situations it is desirable that the swimmer's feet engage the surface 30 of the timing apparatus 10 without slipping. The surface 30 may be covered by a material that is sprayed on or applied with an adhesive. Alternatively, the surface 30 may be textured by cutting or conditioning to create small ridges, valleys or similar surface effects to create the rough surface without adding or applying additional materials to the surface.

In use the timing apparatus 10 is mounted on the side of a swimming pool 36 such that the flange portion 14 engages a side or edge of the swimming pool and the primary portion 12 is at least partially submerged in the water 38, as explained above and illustrated in FIGS. 1 and 9. The primary portion 12 may also engage or touch the side 40 of the swimming pool 36. The timing apparatus 10 is mounted in a swim lane (see, for example, FIG. 32 and corresponding discussion below) such that as a swimmer approaches the end of the lane at the end of a race he or she touches the timing apparatus 10 with a hand (or other body part) to signal arrival at the end of the swim lane. The swimmer's touch causes a vibration that reaches the sensor 18, which produces a signal in response to the vibration. The controller 20 receives the signal from the vibration sensor 18, identifies a touch event from the signal and correlates the swimmer's arrival time with the touch event.

The controller 20 may determine an elapsed time corresponding to a swimmer's race time by receiving a start signal from an external device via the wireless communications module 22, starting a timing clock upon receipt of the start signal, receiving a signal from the sensor 18 and determining that the signal corresponds to a touch event on the timing apparatus 10, stopping the timing clock at a time corresponding to a time of the receipt of the signal from the sensor 18. The controller 20 may then wirelessly communicate the time from the timing clock to an external device as an event time corresponding to the timing apparatus 10, such as a swim lane in which the timing apparatus 10 is mounted. Alternatively, the controller 20 may simply detect a touch event in a manner described above and communicate a wireless signal via the wireless communications module 22 upon detecting the touch event.

A timing apparatus 100 constructed according to another embodiment of the invention is illustrated in FIGS. 11-13. The timing apparatus 100 is similar or identical to the timing apparatus 10, described above, except that it includes a vibration sensor 102 placed on the primary portion 12 of the timing apparatus 100 rather than the flange portion 14. In this embodiment the vibration sensor 102 may be placed in a central region of the primary portion 12 or at or near a center of the primary portion 12, and may be placed on a rear-facing surface 32 of the primary portion 12 or may be placed within a recessed area 104 on the rear-facing surface 32 of the timing apparatus 100. The sensor 102 is shown placed in the recessed area 104 of the rear-facing surface 32 of the primary portion 12 in FIG. 12, and is shown in the recessed area 104 and covered by a layer of material 106 in FIG. 13. Attaching the sensor 102 to the primary portion 12 within the recessed area 104 may allow the sensor 102 to more efficiently detect vibrations of the primary portion 12. It may be desirable to cover the sensor 102 with a layer of material to protect the sensor 102. As illustrated in FIG. 14, the central region 108 of the primary portion 12, as used herein, is an area with a length that is one-half the overall length L of the primary portion, a width that is one-half the overall width W of the primary portion 12, and that is centered along the length and along the width of the primary portion.

The vibration sensor 102 is connected to the controller 20 by a wire 110 or other medium capable of carrying a signal, wherein the wire 110 extends from the sensor 102, along the rear-facing surface 32 of the primary portion 12, around or through the flange portion 14, and into the enclosure 16 where it connects to the controller 20. The wire 110 may be placed within a race (not shown) and covered by an epoxy or other material to protect it from water and other external elements. If the vibration sensor 102 is a piezoelectric sensor connected to the controller 20 via a wire, the sensor would not need an energy source or on-board circuitry to enable operation or communications with the controller 20.

With reference now to FIG. 15, the timing apparatus 100 may include a plurality of vibration sensors placed at various locations on the timing apparatus 100. In a first example, the timing apparatus 100 includes a first vibration sensor 18 placed within the enclosure 16 as explained above and a second vibration sensor 102 placed on the primary portion 12 as explained and illustrated above relative to the timing apparatus 100. If the timing apparatus 100 includes two vibration sensors the controller 20 may receive signals from both sensors and identify a touch event if characteristics of the signals form either or both of the sensors exceeds a predetermined threshold. Using signals from both sensors to identify a touch even may enable more accurate and sensitive detection if, for example, the controller 20 only identifies a touch event if a characteristics from both signals exceeds a predetermined threshold, thereby reducing the risk of a false positive originating from only one of the signals.

The above example includes two vibration sensors, but it will be appreciated that more sensors may be used. It may be desirable, for example, to include two or more vibration sensors 102*a*, 102*b* on the primary portion 12 of the timing apparatus in addition to the single vibration sensor 18 on the flange portion 14, as illustrated in FIG. 15. Similarly, two or more vibration sensors may be placed on the primary portion with no sensor on the flange portion. The particular number and placement of sensors may vary according to the needs arising from the application in which the timing apparatus will be used.

A timing apparatus 200 constructed according to another embodiment of the invention is illustrated in FIGS. 16-19. The timing apparatus 200 may be similar or identical to the timing apparatus 10, described above, except that the timing apparatus 200 includes two different types of sensors, a vibration sensor 18 and a pressure sensor 202. The vibration sensor 18 may be housed within the enclosure 16 as described above, therefore it will not be described in detail here. The vibration sensor 18 may be or include, for example, a piezoelectric sensor.

In addition to the vibration sensor 18, the timing apparatus 200 includes a pressure sensor 202. The pressure sensor 202 may be placed on, or embedded in, the primary portion 12 of the timing apparatus 200 to detect when a pressure is applied to the primary portion 12 of the timing apparatus 200, such as when a swimmer engages the primary portion 12 at the end of a race. As illustrated in FIG. 17, the timing apparatus 200 may include a rigid substrate 204 (which may be, for example, the monolithic element described above) with the pressure sensor 202 placed between the rigid substrate 204 and an outer layer 206 that covers the pressure sensor 202, provides a textured surface for a better grip, etcetera. As illustrated in FIG. 18, the pressure sensor 202 may be a force sensitive resister (FSR) comprising two parallel conductive sheets 208, 210 separated by a conductive or semi-conductive foam material 212. As pressure is applied to the FSR the foam material 212 yields and allows one of the conductive sheets 208, 210 to bend or deflect toward the other, thereby decreasing the resistance between the conductive sheets 208, 210.

The controller 20 is configured to receive signals from both the vibration sensor 18 and the pressure sensor 202 and analyze both signals to determine a touch event. The vibration sensor 18 may be operable to respond to a vibration of the timing apparatus 200 by generating a first signal, and the pressure sensor 202 may be operable to respond to a pressure on the timing apparatus 200 by generating a second signal. The controller 20 may compare signal pattern characteristics from both the vibration sensor 18 and the pressure sensor 202 to predetermined signal characteristics to identify when one or both signals represents a touch event.

Using two different types of sensors has the advantage that a touch event not detected by one type of sensor may be detected by the other type of sensor, and may improve the integrity of the operation of the timing apparatus 200 in certain applications by enabling the controller 20 to more accurately identify a touch event. A gentle touch on a portion of the timing apparatus 200 distal the vibration sensor 18 may result in only a small vibration at the sensor 18 and a weak signal pattern from that sensor. However, if the same touch event involves pressure on the timing apparatus 200 the pressure sensor 202 may readily detect the touch event. Similarly, a tap on the primary portion 12 with little or no pressure may not be detectable by the pressure sensor 202 but may cause a vibration strong enough to be detected by the vibration sensor 18.

The controller 20 may use the first of the two signals to determine a time of the touch event, thus increasing the integrity of the system. The controller 20 may also compare both signals to help eliminate false positives. By way of example, the controller 20 may use a time associated with a vibration signal pattern to determine the time of a touch event and use a signal pattern from the pressure sensor to confirm that the signal pattern from the vibration sensor 18 corresponds to a touch event.

Turning now to FIG. 20, an exemplary force sensitive resistor 214 is illustrated that presents a greater thickness near a bottom of the primary portion 12 (that is, a portion of the primary portion 12 distal the flange portion 14) than at a top of the primary portion. This may be desirable, for example, where water pressure present near the bottom of the primary portion 12 is greater than the water pressure near the top of the primary portion 12. If the force sensitive resister presents a uniform thickness from the top to the bottom, the difference in water pressure may compress lower portions of the sensor and render the sensor less accurate or reliable.

A timing apparatus 300 constructed according to another embodiment of the invention is illustrated in FIGS. 21-22. The timing apparatus 300 is similar or identical to the timing apparatus 10, described above, except that the timing apparatus 300 uses a capacitance sensor 302 rather than a vibration sensor.

The capacitance sensor 302 may include a sheet or layer of conductive material 304, such as steel, tin or aluminum, that spans all or a portion of the primary portion 12, all or a portion of the flange portion 14, or both. In the illustrated embodiment, the sheet of conductive material 304 serves as a sensor electrode and is placed on or proximate front-facing 30 and top-facing 34 surfaces of the timing apparatus 300 wherein the sheet of conductive material 304 is in electrical communication with the controller 20 by way of a conductive element (not shown) connected to the sheet of conductive material 304 under the enclosure 16 and connected to the controller 20 via a hole in the bottom of the enclosure 16. In the illustrated embodiment the conductive sheet 304 is placed against the substrate 306 and beneath a non-conductive outer layer 308 such as vinyl or a similar material. Furthermore, the conductive sheet spans the entire front-facing 30 and top-facing 34 surfaces of the timing apparatus 300 as well as an outer surface of the angled section 26 (see FIG. 5), such that a human touch anywhere on those surfaces or portions of the timing apparatus 300 is detected by the capacitance sensor 302. This is advantageous in that there are no "dead spots" on the timing apparatus where a touch is not detected by sensors or identified by the controller 20.

The capacitance sensor may include electric circuitry 310 (FIG. 22) configured to communicate an excitation signal to the sheet of conductive material 304, detect changes in the conductive sheet's response to the excitation signal and, based on changes to the response, identify a change in capacitance of the sheet of conductive material 304. In the illustrated embodiment, the circuitry 310 includes an excitation signal generator 312 that communicates the excitation signal to both the conductive sheet 304 and circuit modules 314. The circuit modules may include, for example, a sample hold circuit, an analog-to-digital converter, and/or a switched capacitor circuit for transferring charge from the sheet of conductive material 304 to the analog-to-digital converter. The electric circuitry 310 may be separate from but connected to the controller 20, or may be in the same integrated circuit as the controller 20. Furthermore, the controller 20 may perform the functions describe above for the electric circuitry 310 such that it may be difficult or impossible to distinguish some or all of the circuitry 310 from the controller 20. Thus, while the capacitance sensor may be described herein as generating a signal and communicating the signal to the controller 20, it will be understood that that functionality may include the circuitry 310 generating a signal that is communicated to the controller 20, and it may include the controller 20 interacting directly with the conductive sheet 304 to identify a change in capacitance.

When a person touches an outer surface of the timing apparatus 300, the capacitance of the conductive sheet 304 changes and the controller 20 detects the change and identifies a touch event from the change in capacitance. Because the conductive sheet 304 covers or is proximate the entire front-facing surface 30 of the primary portion 12, at least a portion of the top-facing surface 34 of the flange portion 14, and the entire outer surface of the angled section, the timing apparatus is capable of responding to touch events at any of these portions of the timing apparatus. Thus, if a person touches the timing apparatus at an edge of the primary portion or on the angled portion, the touch will be detected. Furthermore, the person need not strike the timing apparatus with any degree of force or apply any degree of pressure for the capacitance sensor to detect the touch.

The capacitance sensor 302 may be configured to detect when a person touches a surface of the timing apparatus 300 or to detect when a person is within a predetermined distance of the timing apparatus 300. Also, the timing apparatus may include both a vibration sensor and a capacitance sensor. In the latter configuration the capacitance sensor may be configured to detect when a person is within a predetermined distance of the timing apparatus and the controller 20 may be configured to identify a touch event only if a signal from the vibration sensor follows a signal from the capacitance sensor within a predetermined time window.

In some embodiments of the invention, it may be necessary for the controller 20 and/or the electric circuitry 310 to be placed in close proximity to the conductive sheet 304, such as where a wire connecting the conductive sheet 304 with the controller 20 presents a capacitance in addition to that of the conductive sheet that affects the ability of the controller 20 or circuitry 310 to detect a change in capacitance of the conductive sheet 304. In the illustrated embodiment, the controller 20 is located in the enclosure 16 and is electrically connected to the conductive sheet 304 via a wire that attaches to the conductive sheet 304 at a location on the conductive sheet 304 within the enclosure 16 such that the wire may be very short (less than one inch) and it is not necessary for the wire to pass through the flange portion 14 of the timing apparatus 300. It may be necessary, for example, for the controller 20 and/or electric circuitry 310 to be located within six inches, twelve inches, eighteen inches or twenty-four inches of the conductive sheet 304 for the capacitance sensor to function properly. In other words, the length of a wire connecting the conductive sheet 304 and the controller 20 and/or electric circuitry 310 may need to be less then twenty-four inches in length for the capacitance sensor to function properly.

In some embodiments of the invention the timing apparatus 300 includes both a vibration sensor and a capacitance sensor. In these embodiments the timing apparatus 300 may include a capacitance sensor like the one described above as well as one or more vibration sensors placed, for example, on the flange portion 14 within the enclosure 16, on the rear-facing surface 32 of the primary portion 12, or both. In one embodiment, the capacitance sensor 302 includes a conductive sheet 304 that spans all or a part of the primary portion 12 but not the flange portion 14, and the vibration sensor is connected directly to the flange portion 14 within the enclosure 16. In that embodiment the conductive sheet 304 may be connected to the controller 20 via a wire.

There are different ways to build and configure a capacitance sensor and the present discussion is exemplary, and not limiting, in nature. The details of the capacitance sensor set forth herein are intended to enable a person of ordinary skill in the art to practice the invention and not to limit the present invention. Indeed, the present invention contemplates various methods of building and using a capacitance sensor with a timing apparatus and alternative design configurations are within the ambit of the present invention.

Turning now to FIGS. 23-27, some embodiments of the invention include a timing apparatus configured to visually convey information to a participant in an aquatic competition. A coach may desire to provide information to a swimmer on his or her team, for example, such as the number of laps left in a race, the swimmer's current standing in the race or other information. An exemplary timing apparatus 400 is illustrated in FIGS. 23-24. The timing apparatus 400 may be similar or identical to the timing apparatus 10, described above, except that the timing apparatus 400 includes a display 402 and related hardware and software as explained herein. The display 402 is mounted on the primary portion 12 such that a front surface of the display 402 is flush with the front-facing surface 30. The display 402 may include a video display device such as a liquid crystal display (LCD) or light-emitting diode (LED) display. The display 402 is configured to present information in the form of still images or moving images including video. The controller 20 controls operation of the display 402 and communicates information to the display 402 for presentation. The controller 20 receives information from an external device and causes the display to present the information, as explained below in greater detail.

The display 402 forms a part of a front touch area of the primary portion 12 of the timing apparatus 400. The front touch area generally comprises those parts of the timing apparatus 400 that are exposed to a swimmer and therefore may be touched by the swimmer and includes the front-facing surface 30. The timing apparatus 400 is configured such that the controller 20 detects a touch event even if the touch event occurs on or over the display 402. FIG. 24 presents an exemplary configuration wherein the display 402 forms part of the front touch area of the primary portion 12 of the timing apparatus 400. The display 402 is located in a recessed portion of the primary portion 12, as explained above, and the entire front-facing surface 30 of the primary portion 12 is covered by a transparent sheet or layer 404. In this configuration the transparent layer 404 may be sealed to the substrate 406 (for example, the monolithic element described above) to prevent water from entering between the two, thus protecting the display 402 from water. The transparent layer 404 may also communicate vibrations to the substrate 406 so that a vibration sensor may be used as described above to detect a touch event on the timing apparatus 400. One or more wires 408 may run from the display 402 through the substrate 406, upward along the rear-facing surface 32 of the substrate 406, and into the enclosure 16 to connect the display 402 with the controller 20 and provide electrical communications between the two. It will be appreciated that the configuration set forth in FIG. 24 is one example of how a display may be built into the timing apparatus and that other, equally preferred configurations may be used and are within the ambit of the present invention. As used herein, the display forms part of the front touch area if it is visible within the front touch area, even if it is covered by a layer of transparent material.

Other forms of active visual indicators are illustrated in FIGS. 25-27. As used herein, an "active visual indicator" is a visual indicator that can change the information it presents. A single light-emitting diode (LED) 410 or other light source may be placed on the primary portion 12 of the timing apparatus, as depicted in FIG. 25, such as in or near the center or within a central region of the primary portion 12. Rather than present still or moving images, the LED 410 may simply be on or off. It may be used, for example, to indicate to a swimmer when he or she is on the last lap of a multi-lap race. Similarly, multiple LEDs (or other light sources) 410*a*, 410*b*, 410*c* may be placed on the primary portion 12 as depicted in FIG. 26. In this configuration, each light source may convey different information to the swimmer. Yet another configuration is depicted in FIG. 27, wherein the light sources 410*a*, 410*b*, 410*c* are placed along an edge of the primary portion 12 so as to be visible to a swimmer but not located directly on the front-facing surface 30 of the primary portion 12 of the timing apparatus. In the configurations depicted in FIGS. 25-27 the controller 20 is communicatively coupled with and controls the light sources.

Turning now to FIGS. 28 and 30, a swimming pool starting block 500 in accordance with another embodiment of the invention includes a starting block timing system 502 comprising a sensor 504, a controller 506, a wireless communications module 508, and an energy storage device 510 such as a battery. The starting block 500 is configured to securely attach to a pool deck and presents a platform 512 that a swimmer stands on prior to a swim race. Upon hearing a start horn or other signal the swimmer begins the race by entering the pool from the platform 512.

The sensor 504, controller 506, wireless communications module 508 and energy storage device 510 may be similar or identical to the devices 302, 20, 24 and 22, described above with differences in configuration and operation discussed here. The sensor 504 may be a capacitance sensor and function as the sensor 302 described above, including a conductive sheet 514 placed at or near a top surface of the platform 512. The conductive sheet 514 may be embedded in or mounted beneath the platform 512 (as illustrated in FIG. 28) and may span most or all of the platform 512. An enclosure 516 is also placed beneath the platform 512 in close proximity (for example, within one-half of an inch) of the conductive sheet 514. The enclosure 516 may be similar or identical to the enclosure 16, described above, and houses the controller 506, the wireless communications module 508 and the energy source 510.

In the embodiment illustrated in FIG. 28, the starting block timing system 502 including the sensor 504, controller 506, wireless communications module 508 and other components or circuitry necessary to enable functionality of the sensor 504 and controller 20 are embedded in the starting block 500 and/or designed to be a permanent part of the starting block 500. In another embodiment of the invention illustrated in FIG. 29 the starting block timing system 502 is designed to be used with a pre-existing starting block and/or removably attached to a starting block that may be used with or without the starting block timing device 502. In the latter embodiment, the sensor 504 may be contained within a pad 518 that is not integral with the starting block 500 but is separate and designed to be placed on top of and/or attached to the platform 512 such that the starting block 500 may be used with or without the pad 518. In that embodiment the sensor 504 may be placed inside the pad 518 while the controller 20 and other components may be in the enclosure 516 placed below or beside the platform 512 and connected to the sensor 504 via one or more wires.

If a capacitance sensor is used in the starting block timing system 502 it may be necessary for the controller 506 that enables or is in communication with the conductive sheet 514 be in close proximity with the conductive sheet 514 for the capacitance sensor 504 to function correctly. For example, the controller 506 may need to be within six inches, twelve inches, eighteen inches or twenty-four inches of the conductive sheet 514 to minimize the length of a communications medium connecting the two and avoid, for example, capacitance associated with the communications medium from interfering with operation of the sensor.

An exemplary aquatic timing system 600 is illustrated in FIG. 31. The system 600 includes a plurality of timing apparatuses 10 in wireless communication with a central control system 602. The central control system 602 may be or include one or more laptop, desktop or server computers, one or more tablet computers, one or more smartphones or other computing devices. The central control system 602 is configured to manage an aquatic sporting event such as a swim race or a swim meet. Each of the timing apparatuses 10 may be placed at an end of a swim lane in a swimming pool to detect when a swimmer finishes a swim race by touching the device. Thus, the system 600 may be used with an eight lane swimming pool wherein one of the timing apparatuses 10 is placed at an end of each lane of the swimming pool so that each lane has one timing apparatus 10. Alternatively, the system 600 may include sixteen timing apparatuses 10 such that a timing apparatus 10 is placed at each end of each lane of an eight lane pool.

An exemplary swimming pool with six swim lanes is illustrated in FIG. 32. While the system 600 includes eight timing apparatuses 10, it may be used with a swimming pool with eight swim lanes or a swimming pool with six swim lanes by, for example, removing two of the timing apparatuses 10. Furthermore, while the swimming pool illustrated in FIG. 32 includes timing apparatuses at only one end of each swim lane, the system may include twelve timing apparatuses total with one timing apparatus at each of each swim lane. The controller associated with each timing apparatus 10 may communicate a signal to the central control system 602 upon detecting a touch event, wherein the signal indicates detection of a touch event. Alternatively, the controller may be configured to manage a time associated with a swim lane by, for example, determining an elapsed time between the start of a race (for example, when a start signal was received from the central computing system) and when a touch event is detected on the timing apparatus 10, and communicating the elapsed time to the central control system 602. If the race includes multiple laps, the controller associated with each timing apparatus may associate touch events with laps and count laps to determine an end of the race and associate a total race time with a touch event associated with the end of the race. The controller associated with each timing apparatus may receive race information from the central control system 602, wherein the race information includes a total race distance, a total number of laps, a distance of each leg of a relay, etcetera.

The central control system 602 may also be connected to a start indicator, such as a starting horn (not shown), via either a wired or wireless connection. The central control system 602 may start a race by activating the start indicator to signal to swimmers that a race is beginning and simultaneously sending an indicator to the timing apparatuses 10 via a wireless signal that the race is starting to enable the controller on each timing apparatus 10 to start a timer. The controller associated with each timing apparatus 10 may stop the timer upon identifying a touch event corresponding to an end of a race from a signal or signals received from the sensor or sensors on the timing apparatus 10. The controller then communicates the elapsed time to the central control system 602 which uses the time for race management. Alternatively, the central control system 602 starts a timer at or near the time it activates the start indicator and assigns an elapsed time to each of the timing apparatuses upon receipt of a signal from the timing apparatus indicating that a touch even has been identified. While the exemplary timing system 600 includes timing apparatuses 10, it will be appreciated that other timing apparatuses may be used without departing from the spirit or scope of the invention. By way of example, any of the timing apparatuses 100, 200, 300 or 400 may be in place of the timing apparatuses 10 in the system 600.

A second timing system 700 is illustrated in FIG. 33. The timing system 700 is similar in form and function to the first timing system 600 except that the timing system 700 includes eight starting block timing systems 502 in addition to eight timing apparatuses 10. Each of the timing apparatuses 10 and each of the starting block timing systems 502 is in wireless communications with a central control system 702. Each of the starting block timing systems 502 is illustrated paired with one of the timing apparatuses 10 because each of the starting block timing systems 502 corresponds to a starting block for a swim lane and the corresponding timing apparatus 10 is also placed for use in that same swim lane. While the exemplary timing system 700 includes timing apparatuses 10, it will be appreciated that other timing apparatuses may be used without departing from the spirit or scope of the invention. By way of example, any of the timing apparatuses 100, 200, 300 or 400 may be in place of the timing apparatuses 10 in the system 700.

Each starting block timing system 502 is configured to communicate a wireless signal to the central control system 702 indicating when a person has left the starting block platform. The central control system 702 uses this information to, for example, determine whether a swimmer left the starting block before a start horn sounded or to determine whether a second swimmer left the platform before a first swimmer touched the corresponding timing apparatus 10 in a relay competition. The system 700 may also be used to determine an amount of time that elapsed between the sounding of a start signal and the departure of a swimmer from a starting block, or an amount of time that elapsed between the arrival of a first swimmer at the end of a lane and the departure of a second swimmer in the same lane as part of a relay competition. This information may be useful, for example, to assist swimmers and swim teams in practicing.

A third exemplary timing system 800 is illustrated in FIG. 34. The timing system 800 includes a central control system 802 and a plurality of timing apparatuses 400 and may be similar or identical to the timing system 600, described above, except that the system 800 includes a plurality of electronic devices 804, 806 also in wireless communication with the central control system 802. The wireless devices 804, 806 may be or include smartphones, tablets or other hand-held computing devices. While two devices 804, 806 are shown for simplicity and illustration, it will be appreciated that various numbers of electronic devices may be used and in wireless communication with the central control system 802 including eight, ten, twenty, thirty or more devices. In some embodiments of the invention hundreds or even thousands of such devices may be used with the system 800.

The devices 804, 806 are configured to receive information from the central control system 802, communicate information to the central control system 802, or both. For example, the devices 804, 806 may be configured to receive competition results, such as swim race times and places, and present the results to a user via a user interface (not shown) associated with the device. Similarly, the devices 804, 806 may be configured to communicate information to the central control system 802 for use by the system 802 or to be communicated by the system 802 to one or more of the timing apparatuses 400 for presentation to a swimmer via a display (such as display 402) or via a light source (such as light emitting diode 410). In some applications, the devices 804, 806 may be used by coaches to communicate competition information to competitors via displays or light sources on the timing apparatuses 400. That information may include, for example, a number of laps left in a race, strategy suggestions, or both. In some applications, the devices 804, 806 may be used by spectators to view competition information and results, wherein hundreds or even thousands of such devices may be included in the system 800.

While not illustrated, the timing system 800 may include a different number of timing apparatuses 400, including six, eight, twelve or sixteen. Furthermore, the timing system 800 may include a plurality of starting blocks 502 as explained above in relation to the system 700.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. An aquatic timing system comprising:

a plurality of timing apparatuses, each timing apparatus including— a rigid and planar primary portion with a length of between four feet and eight feet and a width of between one foot and four feet, the primary portion including a front touch area and a display for presenting visual information, the display forming part of the front touch area;

a flange portion extending from an edge of the primary portion such that the primary portion and the flange portion form an angle of between forty-five degrees and one hundred thirty-five degrees, the flange portion being smaller than the primary portion;

one or more sensors for detecting a touch event occurring on the front touch area of the primary portion, including a touch event occurring on or over the display, and generating one or more signals in response to detecting the touch event; and an enclosure mounted on the flange portion, the enclosure containing a timing apparatus controller in communication with the sensor, the timing apparatus controller configured to— receive the one or more signals from the one or more sensors and identify a touch event from the one or more signals, communicate a wireless signal including event time information associated with the timing apparatus, and receive a wireless signal containing event information and cause the display to present the event information; and a central control system in wireless communication with each of the timing apparatuses and configured to receive the wireless signal from each timing apparatus and determine an outcome of an event.

2. The aquatic timing system as set forth in claim 1, the one or more sensors including a vibration sensor operable to detect the touch event by detecting a vibration on the flange portion that originated from the touch event occurring on the front touch area of the primary portion.

3. The aquatic timing system as set forth in claim 2, the vibration sensor being a piezoelectric sensor.

4. The aquatic timing system as set forth in claim 2, the vibration sensor operable to respond to a touch event on an angled section defined by the intersection of the primary portion and the flange portion by generating the signal.

5. The aquatic timing system as set forth in claim 4, the vibration sensor further operable to— respond to a touch event anywhere on the primary portion, including edges of the primary portion, by generating the signal, and respond to a touch event anywhere on the flange portion, including edges of the flange portion, by generating the signal.

6. The aquatic timing system as set forth in claim 1, the display being chosen from the group consisting of a liquid crystal display and a light-emitting diode display.

7. The aquatic timing system as set forth in claim 1, each of the timing apparatus controllers further configured to— identify a touch event from the one or more signals by comparing a characteristic of the one or more signals with a threshold for the characteristic, receive a second wireless signal, and in response to information received in the second wireless signal, adjust the sensitivity of the timing apparatus by adjusting the threshold for the signal characteristic.

8. The aquatic timing system as set forth in claim 1, the display being located in a central region of the primary portion.

9. The aquatic timing system as set forth in claim 1, the display having a width of between two inches and ten inches and a height of between two inches and ten inches.

10. An aquatic timing system, the system comprising:

a plurality of timing apparatuses, each timing apparatus including— a rigid and planar primary portion with a length of between four feet and eight feet and a width of between one foot and four feet, the primary portion including a front touch area and an active visual indicator for presenting visual information, the active visual indicator being associated with the front touch area;

a flange portion extending from an edge of the primary portion such that the primary portion and the flange portion form an angle of between forty-five degrees and one hundred thirty-five degrees, the flange portion being smaller than the primary portion;

one or more sensors for detecting a touch event occurring on the front touch area of the primary portion, including a touch event occurring on or over the visual indicator, and generating one or more signals in response to detecting the touch event; and an enclosure mounted on the flange portion, the enclosure containing a timing apparatus controller in communication with the sensor, the timing apparatus controller configured to— receive the one or more signals from the one or more sensors and identify a touch event from the one or more signals, communicate a wireless signal including event time information associated with the timing apparatus, and receive a wireless signal containing event time information and cause the visual indicator to reflect the event information; and a central control system in wireless communication with each of the timing apparatuses and configured to receive the wireless signal from each timing apparatus and determine an outcome of an event.

11. The aquatic timing system as set forth in claim 10, the one or more sensors including a vibration sensor operable to respond to a touch event by generating a signal.

12. The aquatic timing system as set forth in claim 11, the vibration sensor operable to respond to a touch event on an angled section defined by the intersection of the primary portion and the flange portion by generating the signal.

13. The aquatic timing system as set forth in claim 12, the vibration sensor further operable to— respond to a touch event anywhere on the primary portion, including edges of the primary portion, by generating the signal, and respond to a touch event anywhere on the flange portion, including edges of the flange portion, by generating the signal.

14. The aquatic timing system as set forth in claim 11, the vibration sensor being a piezoelectric sensor.

15. The aquatic timing system as set forth in claim 10, the visual indicator being a single light-emitting diode.

16. The aquatic timing system as set forth in claim 10, the visual indicator being a plurality of light-emitting diodes.

17. The aquatic timing system as set forth in claim 16, the plurality of light-emitting diodes being placed along an edge of the primary portion of the timing apparatus.

18. The aquatic timing system as set forth in claim 10, each of the timing apparatus controllers further configured to— identify a touch event from the signal by comparing a characteristic of the one or more signals with a threshold for the characteristic, receive a second wireless signal, and in response to information received in the second wireless signal, adjust the sensitivity of the timing apparatus by adjusting the threshold for the signal characteristic.

19. The aquatic timing system as set forth in claim 10, the active visual indicator forming a part of the front touch area and the one more sensors being configured to detect a touch event occurring on or over the active visual indicator.

* * * * *